US008974248B2

(12) United States Patent
Lan et al.

(10) Patent No.: US 8,974,248 B2
(45) Date of Patent: Mar. 10, 2015

(54) UNIVERSAL SERIAL BUS CONNECTOR

(71) Applicant: Cheng Uei Precision Industry Co., Ltd., New Taipei (TW)

(72) Inventors: Rong-Qin Lan, Dong-Guan (CN); Ping-Chih Chen, New Taipei (TW); Yin-Lung Wu, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 188 days.

(21) Appl. No.: 13/848,721

(22) Filed: Mar. 21, 2013

(65) Prior Publication Data

US 2014/0287623 A1 Sep. 25, 2014

(51) Int. Cl.

| | |
|---|---|
| ***H01R 13/648*** | (2006.01) |
| ***H01R 13/405*** | (2006.01) |
| *H01R 13/6581* | (2011.01) |
| *H01R 24/60* | (2011.01) |
| *H01R 27/02* | (2006.01) |

(52) U.S. Cl.

CPC ..... *H01R 13/405* (2013.01); *H01R 13/6581* (2013.01); *H01R 24/60* (2013.01); *H01R 27/02* (2013.01)

USPC ..... 439/607.01

(58) Field of Classification Search

CPC ..... H01R 13/518; H01R 13/65802; H01R 23/6873; H01R 13/658; H01R 23/7073; H01R 13/506; H01R 23/025; H01R 13/514; H04Q 1/142

USPC ..... 439/607.01, 540.1

See application file for complete search history.

(56) References Cited

U.S. PATENT DOCUMENTS

| | | | | |
|---|---|---|---|---|
| 5,259,052 | A * | 11/1993 | Briggs et al. | 385/78 |
| 5,419,717 | A * | 5/1995 | Abendschein et al. | 439/577 |
| 6,183,292 | B1 * | 2/2001 | Chen et al. | 439/541.5 |
| 6,217,371 | B1 * | 4/2001 | Wu | 439/490 |
| 6,478,610 | B1 * | 11/2002 | Zhou et al. | 439/490 |
| 6,540,563 | B1 * | 4/2003 | Hu et al. | 439/676 |
| 6,755,685 | B1 * | 6/2004 | Espenshade | 439/541.5 |
| 7,008,762 | B2 * | 3/2006 | Zhang et al. | 439/541.5 |
| 7,393,238 | B2 * | 7/2008 | Xuan et al. | 439/490 |
| 7,547,217 | B1 * | 6/2009 | Lin | 439/76.1 |
| 7,588,458 | B2 * | 9/2009 | He et al. | 439/541.5 |
| 7,651,370 | B2 * | 1/2010 | Chuang | 439/540.1 |
| 7,695,318 | B1 * | 4/2010 | Wang et al. | 439/607.01 |
| 7,762,840 | B2 * | 7/2010 | Hamner et al. | 439/541.5 |
| 7,785,135 | B2 * | 8/2010 | Wu | 439/490 |
| 7,874,868 | B2 * | 1/2011 | Chang | 439/540.1 |

(Continued)

*Primary Examiner* — Abdullah Riyami
*Assistant Examiner* — Vladimir Imas
(74) *Attorney, Agent, or Firm* — Cheng-Ju Chiang

(57) ABSTRACT

A universal serial bus connector includes an insulating housing, a plurality of first terminals, a plurality of second terminals, an insulating cover, a terminal module and a shielding shell surrounding the insulating housing, the insulating cover and the terminal module. The insulating housing includes a first base body which defines a first holding groove and a second base body which defines a second holding groove. The first terminals and the second terminals are disposed to the first base body. The insulating cover has a main body received in the first holding groove. The terminal module includes an insulating base and a plurality of third terminals integrally molded to the insulating base. The insulating base has a tongue portion received in the second holding groove, and a second supporting portion. A rear surface of the second supporting portion is flush with a rear surface of the first base body.

9 Claims, 6 Drawing Sheets

(56) References Cited

U.S. PATENT DOCUMENTS

| | | | | |
|---|---|---|---|---|
| 7,922,525 | B2 * | 4/2011 | Lee | 439/541.5 |
| 7,967,631 | B2 * | 6/2011 | Wang et al. | 439/541.5 |
| 8,038,474 | B2 * | 10/2011 | Ju | 439/607.01 |
| 8,096,831 | B2 * | 1/2012 | Hsu et al. | 439/607.01 |
| 8,475,213 | B2 * | 7/2013 | Wang et al. | 439/620.05 |
| 8,814,443 | B2 * | 8/2014 | He et al. | 385/75 |
| 2010/0158449 | A1 * | 6/2010 | Yi | 385/75 |

* cited by examiner

UNIVERSAL SERIAL BUS CONNECTOR

BACKGROUND OF THE INVENTION

1. Field of the Invention

The present invention generally relates to a connector, and more particularly to a universal serial bus connector.

2. The Related Art

As is known to all, a conventional universal serial bus connector includes an insulating housing, a plurality of terminals, an insulating cover and a shielding shell surrounding the insulating housing and the insulating cover. The insulating housing defines a receiving space penetrating through a middle of a front surface thereof. Each of the terminals has a fastening portion, a contact portion connecting with one end of the fastening portion and a soldering portion connecting with the other end of the fastening portion. The terminals are disposed to the insulating housing with the contact portions thereof being exposed to the receiving space or being exposed beyond a top surface of the insulating housing and the soldering portions thereof projecting behind the insulating housing. The insulating cover is fastened to a rear end of the insulating housing and a rear end of the insulating cover projects behind the insulating housing. The soldering portions of the terminals penetrate through the insulating cover and are exposed to a top surface of the rear end of the insulating cover. The conventional universal serial bus connector is soldered with a cable which includes a plurality of core wires. The core wires of the cable are soldered with the soldering portions of the terminals.

However, the rear end of the insulating cover of the conventional universal serial bus connector projects behind the insulating housing that increases an exposed volume of the conventional universal serial bus connector. As a result, the conventional universal serial bus connector needs a larger space to be occupied.

SUMMARY OF THE INVENTION

An object of the present invention is to provide a universal serial bus connector. The universal serial bus connector includes an insulating housing, a plurality of first terminals, a plurality of second terminals, an insulating cover, a terminal module and a shielding shell. The insulating housing includes a first base body, and a second base body protruding upward from one side of a top surface of the first base body. The first base body defines a first inserting groove penetrating through a front surface thereof and a first holding groove penetrating through a rear surface thereof. The second base body defines a second inserting groove penetrating through a top surface and a front surface thereof and a second holding groove penetrating through a bottom of a rear surface thereof and communicating with the second inserting groove. The first terminals are disposed to the first base body of the insulating housing. Each of the first terminals has a first fastening portion, a first contact portion extending forward from a front of the first fastening portion, a first bending portion bent upward from a rear of the first fastening portion and a first soldering portion extending rearward from a top of the first bending portion. A top of the first contact portion is exposed to the first inserting groove. A rear end of the first soldering portion of each first terminal projects behind the insulating housing. The second terminals are disposed to the first base body of the insulating housing. Each of the second terminals has a second fastening portion, a second contact portion extending forward from a front of the second fastening portion, a second bending portion bent downward from a rear of the second fastening portion and a second soldering portion extending rearward from a bottom of the second bending portion. A bottom of the second contact portion is exposed to the first inserting groove. A rear end of the second soldering portion of each second terminal projects behind the insulating housing. The insulating cover is fastened to a rear end of the first base body of the insulating housing. The insulating cover has a main body and a first supporting portion protruding rearward from a middle of a rear surface of the main body. The main body of the insulating cover is received in the first holding groove and the rear surface of the main body is flush with the rear surface of the first base body. The first supporting portion of the insulating cover projects behind the rear end of the first base body of the insulating housing. The rear ends of the first soldering portions of the first terminals and the rear ends of the second soldering portions of the second terminals are exposed to a top of the first supporting portion. The terminal module is fastened to a rear end of the second base body of the insulating housing. The terminal module includes an insulating base and a plurality of third terminals integrally molded to the insulating base. The insulating base has a base portion, a tongue portion protruding forward from a middle of a lower portion of a front surface of the base portion and a second supporting portion protruding rearward from a bottom of a rear surface of the base portion. The tongue portion of the insulating base is received in the second holding groove of the second base body. The base portion of the insulating base is blocked behind the rear surface of the second base body. The second supporting portion of the insulating base projects behind the second base body and a rear surface of the second supporting portion is flush with the rear surface of the first base body. The third terminal of the terminal module has a third fastening portion integrally molded in the insulating base, a third contact portion extending forward, then arched upward and further extending forward from a front of the third fastening portion to project beyond a front surface of the insulating base and a third soldering portion extending rearward from a rear of the third fastening portion to be exposed to a top of the second supporting portion. Tops of the third contact portions are exposed to the second inserting groove. The shielding shell surrounds the insulating housing, the insulating cover and the terminal module.

As described above, the main body of the insulating cover is received in the first holding groove of the insulating housing, and the tongue portion of the insulating base of the terminal module is received in the second holding groove of the insulating housing and the rear surface of the second supporting portion is flush with the rear surface of the first base body, so that an exposed volume of the universal serial bus connector is decreased. As a result, an occupying space of the universal serial bus connector is decreased.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
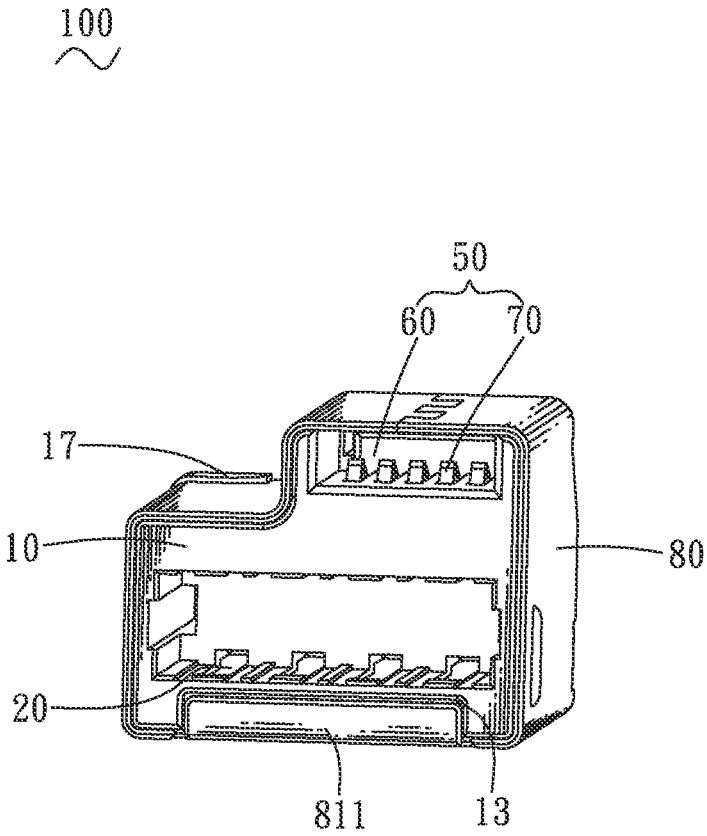
FIG. 1 is a perspective view of a universal serial bus connector in accordance with the present invention.
Figure 2:
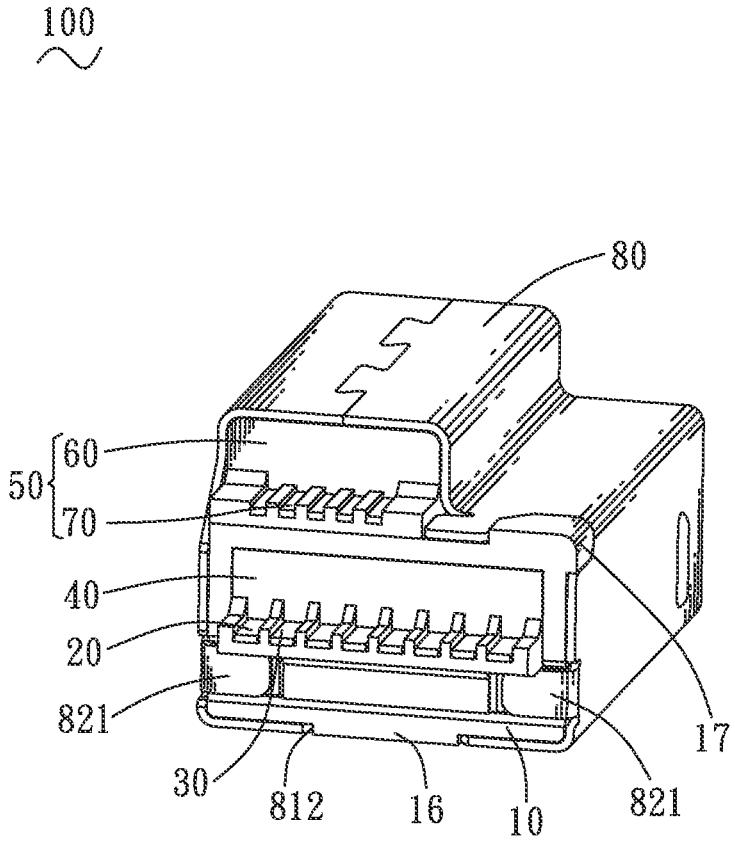
FIG. 2 is another perspective view of the universal serial bus connector of FIG. 1.

With reference to FIG. 1, FIG. 2 FIG. 3 and FIG. 4, an universal serial bus connector 100 in accordance with the present invention is shown. The universal serial bus connector 100 includes an insulating housing 10, a plurality of first terminals 20, a plurality of second terminals 30, an insulating cover 40, a terminal module 50 and a shielding shell 80.

Figure 3:
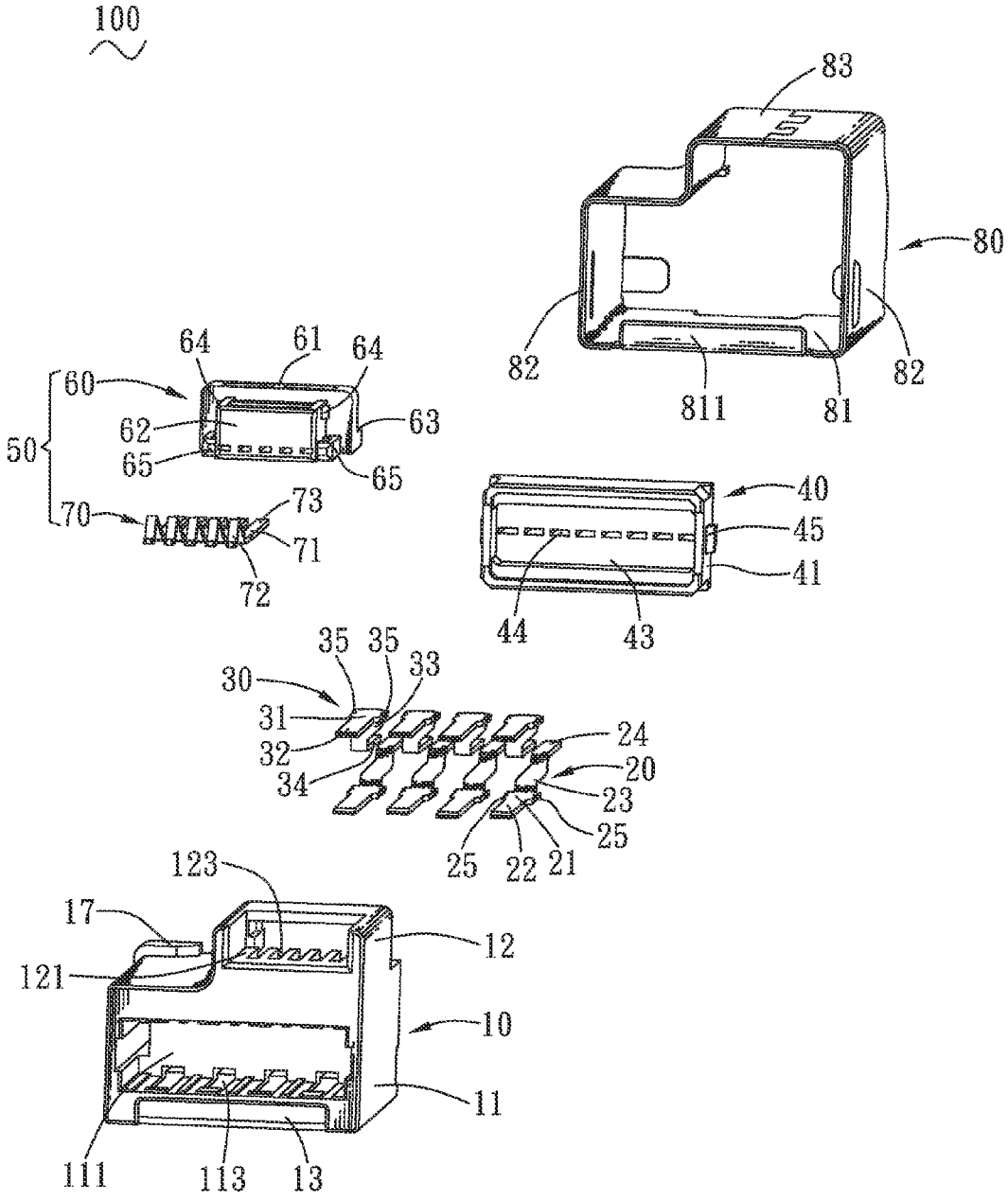
FIG. 3 is an exploded view of the universal serial bus connector of FIG. 1.
Figure 4:
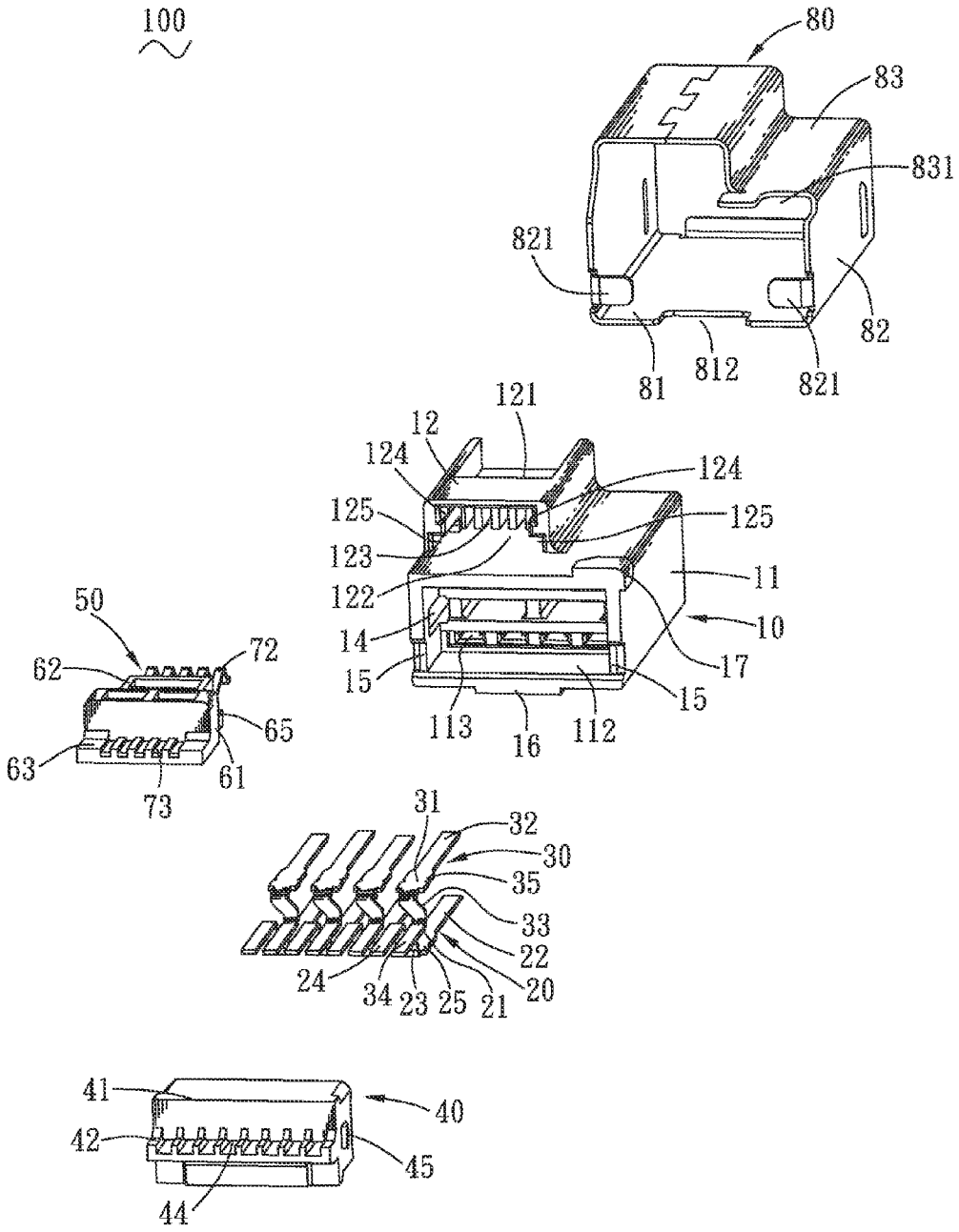
FIG. 4 is another exploded view of the universal serial bus connector of FIG. 1.
Figure 5:
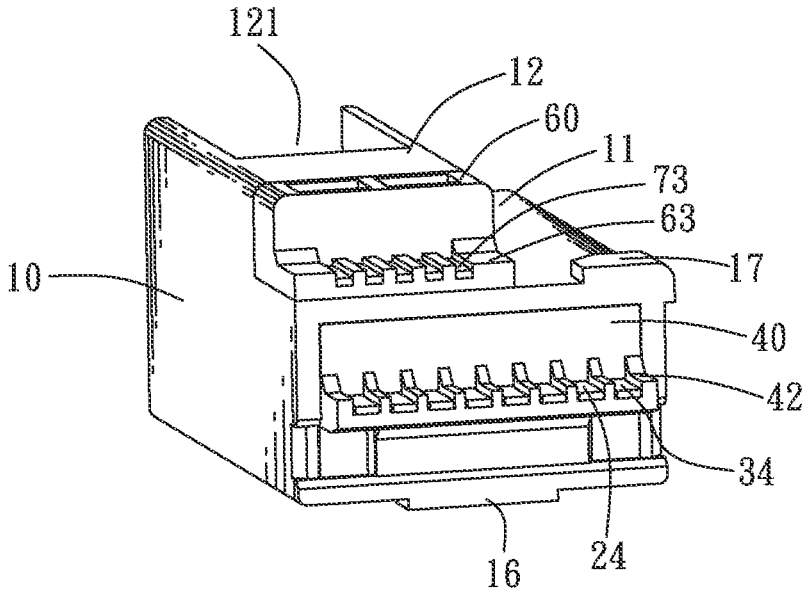
FIG. 5 is a partially perspective view of the universal serial bus connector of FIG. 1.
Figure 6:
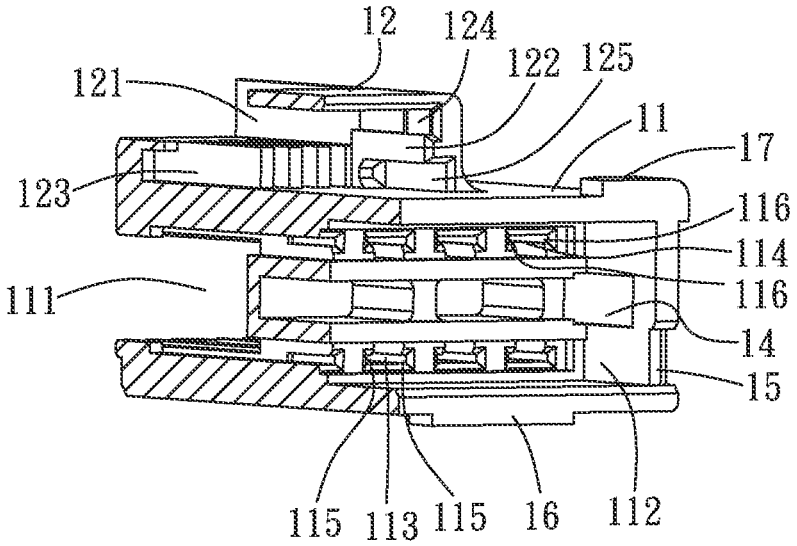
FIG. 6 is a sectional view of an insulating housing of the universal serial bus connector of FIG. 1.

Referring to FIG. 3, FIG. 4 and FIG. 6, the insulating housing 10 includes a rectangular first base body 11, and a rectangular second base body 12 protruding upward from one side of a top surface of the first base body 11. The first base body 11 defines a first inserting groove 111 penetrating through a middle of a front surface thereof and a first holding groove 112 penetrating through a middle of a rear surface thereof. The first base body 11 defines a plurality of first terminal grooves 113 penetrating through a top surface of a bottom wall and a rear wall of the first inserting groove 111 and communicating with the first holding groove 112, and a plurality of second terminal grooves 114 penetrating through a bottom surface of a top wall and the rear wall of the first inserting groove 111 and communicating with the first holding groove 112. Two rear ends of two inner surfaces of two opposite side walls of the first terminal groove 113 are concaved oppositely to form two first fastening slots 115. Two rear ends of two inner surfaces of two opposite side walls of the second terminal groove 114 are concaved oppositely to form two second fastening slots 116. The second base body 12 defines a second inserting groove 121 penetrating through a top surface and a front surface thereof and a second holding groove 122 penetrating through a bottom of a rear surface thereof and communicating with the second inserting groove 121. The second base body 12 defines a plurality of third terminal grooves 123 penetrating through a top surface of a bottom wall and a rear wall of the second inserting groove 121 and communicating with the second holding groove 122.

Referring to FIG. 3, FIG. 4 and FIG. 6, two tops of two inner surfaces of two opposite side walls of the second holding groove 122 are concaved oppositely to form two first buckling grooves 124. Two bottoms of the two inner surfaces of the two opposite side walls of the second holding groove 122 are concaved oppositely to form two second buckling grooves 125. The front surface of the first base body 11 defines a limiting groove 13 passing through a bottom edge thereof, and the limiting groove 13 is located under the first inserting groove 111. Two inner surfaces of two opposite side walls of the first holding groove 112 are concaved oppositely to form two fixing grooves 14. Two rear surfaces of the two opposite side walls of the first holding groove 112 are concaved inward to form two restricting grooves 15. A middle of a bottom surface of a bottom wall of the first holding groove 112 protrudes downward to form a first locating portion 16. A junction of a top wall and one side wall of the first holding groove 112 protrudes outward to form a second locating portion 17.

Referring to FIG. 3 and FIG. 4, each of the first terminals 20 has an elongated first fastening portion 21 disposed horizontally, a first contact portion 22 extending forward from a front of the first fastening portion 21, a first bending portion 23 bent upward from a rear of the first fastening portion 21, and a first soldering portion 24 extending rearward from a top of the first bending portion 23. Two opposite sides of a rear end of the first fastening portion 21 protrude oppositely to form two first teeth portions 25.

Referring to FIG. 3 and FIG. 4, each of the second terminals 30 has an elongated second fastening portion 31 disposed horizontally, a second contact portion 32 extending forward from a front of the second fastening portion 31, a second bending portion 33 bent downward from a rear of the second fastening portion 31, and a second soldering portion 34 extending rearward from a bottom of the second bending portion 33. Two opposite sides of a rear end of the second fastening portion 31 protrude oppositely to form two second teeth portions 35.

Referring to FIG. 3 and FIG. 4, the insulating cover 40 has a main body 41 and a first supporting portion 42 protruding rearward from a middle of a rear surface of the main body 41. The main body 41 of the insulating cover 40 defines an opening 43 penetrating through a middle of a front surface thereof. The insulating cover 40 defines a plurality of insertion slots 44 penetrating through a top surface of the first supporting portion 42 and further penetrating through the rear surface of the main body 41 to communicate with the opening 43. Two opposite side surfaces of the main body 41 protrude outward to form two fixing blocks 45.

Referring to FIG. 3 and FIG. 4, the terminal module 50 includes an insulating base 60 and a plurality of third terminals 70 integrally molded to the insulating base 60. The insulating base 60 has a base portion 61, a tongue portion 62 protruding forward from a middle of a lower portion of a front surface of the base portion 61 and a second supporting portion 63 protruding rearward from a bottom of a rear surface of the base portion 61. Two tops of two opposite side surfaces of the tongue portion 62 of the insulating base 60 protrude outward to form two axe-shaped first buckling portions 64. Two bottoms of the two opposite side surfaces of the tongue portion 62 of the insulating base 60 protrude outward to form two rectangular second buckling portions 65. The third terminal 70 of the terminal module 50 has a third fastening portion 71 integrally molded in the insulating base 60, a third contact portion 72 extending forward, then arched upward and further extending forward from a front of the third fastening portion 71 to project beyond a front surface of the insulating base 60 and a third soldering portion 73 extending rearward from a rear of the third fastening portion 71 to be exposed to a top of the second supporting portion 63. The third soldering portions 73 of the third terminals 70 are in alignment with one another.

Referring to FIG. 3 and FIG. 4, the shielding shell 80 has a bottom plate 81, two lateral plates 82 extending upward from two opposite sides of the bottom plate 81 and a top plate 83 extending towards each other from two tops of the two lateral plates 82. A middle of a front edge of the bottom plate 81 is bent upward to form a limiting piece 811. A middle of a rear edge of the bottom plate 81 is recessed inward to form a first locating groove 812. Two bottoms of two rear edges of the two lateral plates 82 define two restricting pieces 821. One side of a rear edge of the top plate 83 is recessed inward to form a second locating groove 831.

Referring to FIG. 1, FIG. 2, FIG. 3, FIG. 4, FIG. 5 and FIG. 6, when the universal serial bus connector 100 is assembled, at first, the first terminals 20 and the second terminals 30 are disposed to the first base body 11 of the insulating housing 10. Specifically, the first fastening portion 21 of each first terminal 20 is fastened to the first terminal groove 113. The two first teeth portions 25 are fastened to the two first fastening slots 115 and interfere with two inner surfaces of two opposite side walls of the two first fastening slots 115. The first contact portion 22 of each first terminal 20 is received in the first terminal groove 113 and a top of the first contact portion 22 is exposed to the first inserting groove 111. The first bending portion 23 of each first terminal 20 and a front end of the first soldering portion 24 of each first terminal 20 are located in the first holding groove 112. A rear end of the first soldering portion 24 of each first terminal 20 projects behind the insulating housing 10. The second fastening portion 31 of each second terminal 30 is disposed to the second terminal groove 114. The two second teeth portions 35 are fastened to the two second fastening slots 116 and interfere with two inner surfaces of two opposite side walls of the two second fastening slots 116. The second contact portion 32 of each second terminal 30 is received in the second terminal groove 114 and a bottom of the second contact portion 32 is exposed to the first inserting groove 111. The second bending portion 33 of each second terminal 30 and a front end of the second soldering portion 34 of each second terminal 30 are located in the first holding groove 112. A rear end of the second soldering portion 34 of each second terminal 30 projects behind the insulating housing 10.

Referring to FIGS. 1-6, next, the insulating cover 40 is fastened to a rear end of the first base body 11 of the insulating housing 10. Specifically, the main body 41 of the insulating cover 40 is received in the first holding groove 112 and the rear surface of the main body 41 is flush with the rear surface of the first base body 11. The two fixing blocks 45 of the insulating cover 40 are fixed in the two fixing grooves 14 of the insulating housing 10 so that the insulating cover 40 is fastened to the rear end of the first base body 11 of the insulating housing 10. The first supporting portion 42 of the insulating cover 40 projects behind the rear end of the first base body 11 of the insulating housing 10. The rear ends of the first soldering portions 24 of the first terminals 20 and the rear ends of the second soldering portions 34 of the second terminals 30 are inserted into the insertion slots 44 of the insulating cover 40 through the opening 43 of the insulating cover 40 and exposed to a top of the first supporting portion 42. The rear ends of the first soldering portions 24 and the rear ends of the second soldering portions 34 are in alignment with one another.

Referring to FIGS. 1-6, the terminal module 50 is fastened to a rear end of the second base body 12 of the insulating housing 10. Specifically, the tongue portion 62 of the insulating base 60 is received in the second holding groove 122 of the second base body 12. The first buckling portions 64 of the insulating base 60 are buckled in the first buckling grooves 124 and the second buckling portions 65 of the insulating base 60 are buckled in the second buckling grooves 125. The base portion 61 of the insulating base 60 is blocked behind a rear surface of the second base body 12. The second supporting portion 63 of the insulating base 60 projects behind the second base body 12 and a rear surface of the second supporting portion 63 is flush with the rear surface of the first base body 11. The third contact portions 72 of the third terminals 70 are received in the third terminal grooves 123 and tops of the third contact portions 72 are exposed to the second inserting groove 121.

Referring to FIGS. 1-6, at last, the shielding shell 80 surrounding the insulating housing 10, the insulating cover 40 and the terminal module 50. Specifically, the insulating housing 10 together with the first terminals 20, the second terminals 30, the insulating cover 40 and the terminal module 50 is inserted forward in the shielding shell 80. The limiting piece 811 of the shielding shell 80 is limited in the limiting groove 13 of the insulating housing 10. The first locating portion 16 is located in the first locating groove 812 and the second locating portion 17 is located in the second locating groove 831. The restricting pieces 821 of the shielding shell 80 are bent towards each other by a jig (not shown) to be restricted in the restricting grooves 15 of the insulating housing 10.

Referring to FIGS. 1-6, the universal serial bus connector 100 is soldered with a cable (not shown) which includes a plurality of core wires (not shown). The core wires of the cable are soldered with the rear ends of the first soldering portions 24 of the first terminals 20, the rear ends of the second soldering portions 34 of the second terminals 30 which are exposed to the first supporting portion 42 of the insulating cover 40 and the third soldering portions 73 of the third terminals 70 which are exposed to the top of the second supporting portion 63 of the insulating base 60.

As described above, the main body 41 of the insulating cover 40 is received in the first holding groove 112 of the insulating housing 10, and the tongue portion 62 of the insulating base 60 of the terminal module 50 is received in the second holding groove 122 of the insulating housing 10 and the rear surface of the second supporting portion 63 is flush with the rear surface of the first base body 11, so that an exposed volume of the universal serial bus connector 100 is decreased. As a result, an occupying space of the universal serial bus connector 100 is decreased.

What is claimed is:

1. A universal serial bus connector, comprising:

an insulating housing including a first base body, and a second base body protruding upward from one side of a top surface of the first base body, the first base body defining a first inserting groove penetrating through a front surface thereof and a first holding groove penetrating through a rear surface thereof, the second base body defining a second inserting groove penetrating through a top surface and a front surface thereof and a second holding groove penetrating through a bottom of a rear surface thereof and communicating with the second inserting groove;

a plurality of first terminals disposed to the first base body of the insulating housing, each of the first terminals having a first fastening portion, a first contact portion extending forward from a front of the first fastening portion, a first bending portion bent upward from a rear of the first fastening portion and a first soldering portion extending rearward from a top of the first bending portion, a top of the first contact portion being exposed to the first inserting groove, a rear end of the first soldering portion of each first terminal projecting behind the insulating housing;

a plurality of second terminals disposed to the first base body of the insulating housing, each of the second terminals having a second fastening portion, a second contact portion extending forward from a front of the second fastening portion, a second bending portion bent downward from a rear of the second fastening portion and a second soldering portion extending rearward from a bottom of the second bending portion, a bottom of the second contact portion being exposed to the first inserting groove, a rear end of the second soldering portion of each second terminal projecting behind the insulating housing;

an insulating cover fastened to a rear end of the first base body of the insulating housing, the insulating cover having a main body and a first supporting portion protruding rearward from a middle of a rear surface of the main body, the main body of the insulating cover being received in the first holding groove and the rear surface of the main body being flush with the rear surface of the first base body, the first supporting portion of the insulating cover projecting behind the rear end of the first base body of the insulating housing, the rear ends of the first soldering portions of the first terminals and the rear ends of the second soldering portions of the second terminals being exposed to a top of the first supporting portion;

a terminal module fastened to a rear end of the second base body of the insulating housing, the terminal module including an insulating base and a plurality of third terminals integrally molded to the insulating base, the insulating base having a base portion, a tongue portion protruding forward from a middle of a lower portion of a front surface of the base portion and a second supporting portion protruding rearward from a bottom of a rear surface of the base portion, the tongue portion of the insulating base being received in the second holding groove of the second base body, the base portion of the insulating base being blocked behind the rear surface of the second base body, the second supporting portion of the insulating base projecting behind the second base body and a rear surface of the second supporting portion being flush with the rear surface of the first base body, the third terminal of the terminal module having a third fastening portion integrally molded in the insulating base, a third contact portion extending forward, then arched upward and further extending forward from a front of the third fastening portion to project beyond a front surface of the insulating base and a third soldering portion extending rearward from a rear of the third fastening portion to be exposed to a top of the second supporting portion, tops of the third contact portions being exposed to the second inserting groove; and a shielding shell surrounding the insulating housing, the insulating cover and the terminal module.

2. The universal serial bus connector as claimed in claim 1, wherein two tops of two inner surfaces of two opposite side walls of the second holding groove are concaved oppositely to form two first buckling grooves, two bottoms of the two inner surfaces of the two opposite side walls of the second holding groove are concaved oppositely to form two second buckling grooves, two tops of two opposite side surfaces of the tongue portion of the insulating base protrude outward to form two axe-shaped first buckling portions, two bottoms of the two opposite side surfaces of the tongue portion of the insulating base protrude outward to form two rectangular second buckling portions, the first buckling portions of the insulating base are buckled in the first buckling grooves and the second buckling portions of the insulating base are buckled in the second buckling grooves.

3. The universal serial bus connector as claimed in claim 1, wherein two inner surfaces of two opposite side walls of the first holding groove are concaved oppositely to form two fixing grooves, two opposite side surfaces of the main body protrude outward to form two fixing blocks, the two fixing blocks of the insulating cover are fixed in the two fixing grooves of the insulating housing.

4. The universal serial bus connector as claimed in claim 1, wherein the second base body defines a plurality of third terminal grooves penetrating through a top surface of a bottom wall and a rear wall of the second inserting groove and communicating with the second holding groove, the third contact portions of the third terminals are received in the third terminal grooves and tops of the third contact portions are exposed to the second inserting groove.

5. The universal serial bus connector as claimed in claim 1, wherein the front surface of the first base body defines a limiting groove passing through a bottom edge thereof, and the limiting groove is located under the first inserting groove, the shielding shell has a bottom plate, a middle of a front edge of the bottom plate is bent upward to form a limiting piece, the limiting piece of the shielding shell is limited in the limiting groove of the insulating housing.

6. The universal serial bus connector as claimed in claim 5, wherein a middle of a bottom surface of a bottom wall of the first holding groove protrudes downward to form a first locating portion, a junction of a top wall and one side wall of the first holding groove protrudes outward to form a second locating portion, the shielding shell has two lateral plates extending upward from two opposite sides of the bottom plate and a top plate extending towards each other from two tops of the two lateral plates, a middle of a rear edge of the bottom plate is recessed inward to form a first locating groove, one side of a rear edge of the top plate is recessed inward to form a second locating groove, the first locating portion is located in the first locating groove and the second locating portion is located in the second locating groove.

7. The universal serial bus connector as claimed in claim 5, wherein two rear surfaces of the two opposite side walls of the first holding groove are concaved inward to form two restricting grooves, the shielding shell has two lateral plates extending upward from two opposite sides of the bottom plate, two bottoms of two rear edges of the two lateral plates define two restricting pieces, the restricting pieces of the shielding shell are bent towards each other by a jig to be restricted in the restricting grooves of the insulating housing.

8. The universal serial bus connector as claimed in claim 1, wherein the main body of the insulating cover defines an opening penetrating through a middle of a front surface thereof, the insulating cover defines a plurality of insertion slots penetrating through a top surface of the first supporting portion and further penetrating through the rear surface of the main body to communicate with the opening, the rear ends of the first soldering portions of the first terminals and the rear ends of the second soldering portions of the second terminals are inserted into the insertion slots of the insulating cover through the opening of the insulating cover and exposed to the top of the first supporting portion.

9. The universal serial bus connector as claimed in claim 8, wherein the rear ends of the first soldering portions and the rear ends of the second soldering portions are in alignment with one another, the third soldering portions of the third terminals are in alignment with one another.

* * * * *